US008955355B1

(12) United States Patent
Dumas

(10) Patent No.: US 8,955,355 B1
(45) Date of Patent: Feb. 17, 2015

(54) LEFLEUR DECORATIVE JEWELRY

(71) Applicant: Karla Darlene Dumas, Detroit, MI (US)

(72) Inventor: Karla Darlene Dumas, Detroit, MI (US)

( * ) Notice: Subject to any disclaimer, the term of this patent is extended or adjusted under 35 U.S.C. 154(b) by 0 days.

(21) Appl. No.: 13/783,795

(22) Filed: Mar. 4, 2013

(51) Int. Cl.
*A44C 7/00* (2006.01)

(52) U.S. Cl.
CPC ..... *A44C 7/00* (2013.01)
USPC ..... 63/13; 63/12

(58) Field of Classification Search
CPC ..... A44C 7/00; A44C 7/001; A44C 7/002; A44C 7/003; A44C 1/00; A44C 15/0035; A44C 25/008; A45F 5/08
USPC ..... 63/12, 13, 20; 24/6
See application file for complete search history.

(56) References Cited

U.S. PATENT DOCUMENTS

| | | | | | |
|---|---|---|---|---|---|
| 26,678 | A | * | 1/1860 | Huber | 63/20 |
| 241,462 | A | * | 5/1881 | Washburn | 63/13 |
| 357,425 | A | * | 2/1887 | Stickel | 24/6 |
| 419,251 | A | * | 1/1890 | Goff | 63/28 |
| 561,893 | A | * | 6/1896 | Jansky | 63/13 |
| 2,490,908 | A | | 5/1946 | Kohler | |
| 2,947,054 | A | | 5/1958 | Adams | |
| 3,088,295 | A | * | 5/1963 | Haines | 63/20 |
| 3,595,031 | A | | 7/1971 | Wiemer | |
| 3,605,438 | A | * | 9/1971 | Chalson | 63/20 |
| 3,630,048 | A | | 12/1971 | Masters | |
| 4,218,894 | A | | 8/1980 | Tropea | |
| 4,776,184 | A | * | 10/1988 | Hakim | 63/20 |
| 4,835,024 | A | * | 5/1989 | Hallay | 428/24 |
| 4,907,424 | A | | 3/1990 | Reinstein et al. | |
| 5,048,311 | A | | 9/1991 | Mastrobuono | |
| 5,487,280 | A | | 1/1996 | D'Amore, Jr. | |
| 5,513,502 | A | | 5/1996 | Seaton, Jr. | |
| D378,360 | S | | 3/1997 | Montaquila | |
| 5,809,159 | A | | 9/1998 | Lee | |
| 5,906,114 | A | | 5/1999 | Rissin | |
| D438,139 | S | | 2/2001 | Mozena | |
| 6,571,579 | B1 | | 6/2003 | Rissin | |
| D516,944 | S | | 3/2006 | Weiser et al. | |
| 7,197,895 | B2 | | 4/2007 | Schwarz | |
| 7,219,515 | B2 | | 5/2007 | Ravenstein | |

* cited by examiner

*Primary Examiner* — Robert J Sandy
*Assistant Examiner* — Abigail Morrell
(74) *Attorney, Agent, or Firm* — Ronald R. Kilponen

(57) ABSTRACT

A decorative floral jewelry device is shown. The device allows the user to change out the beaded center portion of the floral jewelry and also provides at least one rod with platform that affixes to the back of the floral element such that the floral element does not sag thereby deterring from the look of the jewelry. An alternative embodiment shows a jewelry device that has a rod with platform and loop but uses a hook with loop a retention device and clip to fasten a decorative element.

2 Claims, 4 Drawing Sheets

LEFLEUR DECORATIVE JEWELRY

FIELD

The present version of this device relates generally to the field of decorative jewelry and especially that of decorative interchangeable earrings, rings and pins.

BACKGROUND

This device relates to decorative jewelry, and more particularly to a device that allows a user to attach and customize decorative pieces to the ears, body or clothing where the jewelry will remain visible without flopping over and the mechanics not be seen as well.

Many people enjoy decorative jewelry and earrings and many also fashion their own jewelry to match various outfits, holidays or events. Many people also use decorative artificial floral jewelry. One of the problems with using decorative artificial floral jewelry is that many floral decorations are not rigid. This causes a problem in that the floral decorations especially those larger than a certain size, if attached at only one point, can flop over and become not entirely visible. This defeats the whole purpose of the decorative jewelry and earrings and can deter from the overall presentation to the public.

Many people enjoy fashioning their own decorative floral jewelry and there is a need to provide a device that will allow them to fashion their own custom colors and designs that will not flop over and will stay visible to provide the best presentation.

Fashion oriented people enjoy mixing existing jewelry and changing out portions of existing jewelry to create a different and new color or style of floral jewelry or earrings.

For the foregoing reasons, there is a need for a device that will allow users to create their own combinations of decorative jewelry and earrings especially those of the floral nature that will not flop over when affixed to the wearers body or clothing. There is also a need for a device that will allow crafters, custom jewelry makers and manufacturers to use non rigid floral pieces to create custom jewelry or earrings. There is also a need for a device that will allow the relative ease of swapping their custom pieces with other pieces for a different look, holiday theme or color combination.

SUMMARY

In view of the foregoing disadvantages inherent in the area of floral jewelry and earrings there is a need for a device that will allow a user to wear floral earrings or other jewelry. There is a need for a device that will allow a user to have a piece that they can interchange the elements of the jewelry for a custom look. There is a need for a device that will allow the floral decorative piece to remain fully open and not droop or sag.

A first objective is to provide a device that allows the use of non-rigid floral jewelry to remain visible.

Another objective is to provide a device that allows the interchangeability of floral jewelry products.

It is yet another objective to provide a device that allows customization of floral jewelry products.

It is a still further objective to provide a device that will not be too heavy to wear as an earring and still provide for full viewing of the floral portion.

These together with other objectives of this device, along with various features of novelty which characterize this device, are pointed out with particularity in the claims annexed hereto and forming a part of this disclosure. For a better understanding of this device, its operating advantages and the specific objectives attained by its uses, reference should be had to the accompanying drawings, claims and descriptive matter in which there is illustrated a preferred embodiment of the device.

DETAILED DESCRIPTION OF THE PREFERRED EMBODIMENTS

Figure 1:
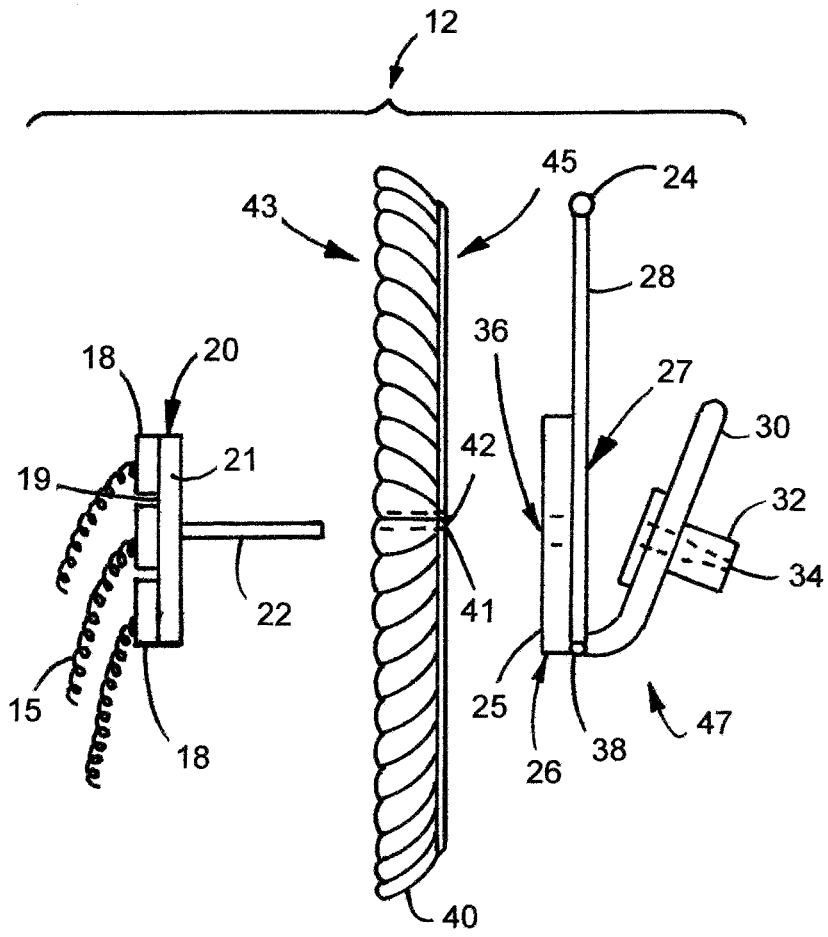
FIG. 1 shows an exploded side view of one embodiment of a decorative earring.

Referring to the drawings in detail wherein like elements are indicated by like numerals, there is shown in FIG. 1 an exploded view of one embodiment of a decorative earring 12. As can be seen, floral element 40 has a center 20 attached to the front 43 of floral element 40.

Figure 2:
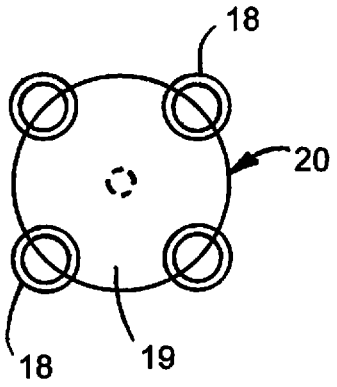
FIG. 2 shows a front view of one embodiment of the front with rings attached.

The center 20 can be circular or any other shape to imitate the center portion of a flower. To the face 19 of the center 20 are attached a plurality of rings 18. In this embodiment there are attached four rings 18 approximately evenly spaced around the edge of the center 20. More or fewer rings 18 could be attached to the face 19, see FIG. 2.

The rings 18 allow for the attachment of strings of beads 15 and or pearls to coordinate with the color of the floral element 40 or to contrast with the floral element 40. The whole center 20 can thereby be changed or swapped out with another embodiment of the center 20 for variety of look, color and appearance.

The floral element 40 is meant to imitate the petals of a flower. This floral element 40 could likewise be of any color, shape or design that was needed to imitate the petals of a real flower.

Other decorative elements besides or in combination with the beads 15 could also be attached to the rings 18 of the center 20.

To the back 21 of the center 20 and approximately centered there upon is located a post 22. Post 22 is long enough to be inserted into and through the floral element 40, the base 26 and clasp 30 through post hole 36 and retaining hole 34 in clasp 30 to be retained in the post holder 32.

The floral element 40 is made from any soft material that imitates a natural flower. The front 43 of the floral element 40 can have crushed sand or other precious or semi precious gem stones or crystals adhered there upon to enhance the look of the floral element 40, or it can just be plain without these additional decorative elements. The floral element 40 has a hole 42 located at the floral center 41.

Figure 3:
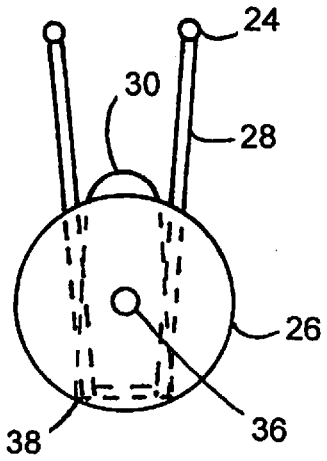
FIG. 3 shows a front view of one embodiment of the base and clasp for the back of the floral element.
Figure 4:
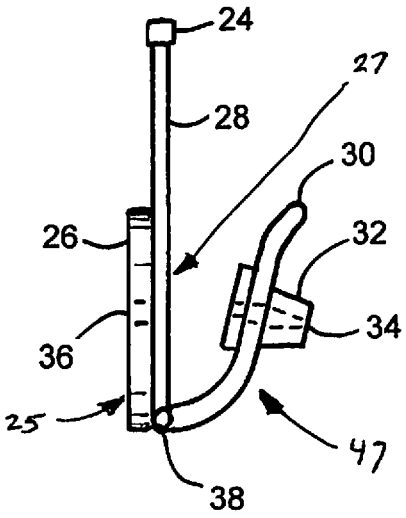
FIG. 4 shows a side detailed view of one embodiment of the holder and related elements that are attached to the back of the floral element.

To the back 45 of the floral element 40 is attached a base 26, rod 28, platform 24 and clasp 30 collectively referred to as holder 47. The base 26 has a front 25 and a back 27. This FIG. 1 shows the clasp 30 in the partially closed position. The clasp 30 rotates around the hinge 38 to open and close on the wearers ear lobe for example. This embodiment of the clasp 30 has a base 26 with a post hole 36 located approximately in the center large enough to allow the post 22 to pass through. In this embodiment, a pair of rods 28 are affixed to the back 27 of the base 26, see FIG. 3. The earring 12 is meant to be worn such that the rods 28 are located in an up orientation relative to the ground.

While this embodiment shows rods 28 that are straight, it should be understood that the rods 28 could be curved, s-shaped or other shapes to effectuate contact with the various petal shapes of the floral element 40. It is the intent to provide an attachment point for the petals of floral element 40 and yet hide the rods 28 as much as possible, hence the need for possibly different shapes and lengths of rods 28.

The rods 28 each have a platform 24 located at one end. While this embodiment shows the platform 24 to be circular and the rods 28 to be linear, it should be understood that platform 24 and rods 28 could be larger or smaller and either circular or of another shape. The shape/size of the platform 24 and rod 28 is dependent upon the size/shape of the petals of the floral element 40. The platforms 24 and rods 28 are designed to provide the best support to the floral element 40 while staying as hidden as possible. Alternatively, there could be more than one platform 24 on the rod 28 and it is not necessarily limited to the end of the rod 28 as shown in this embodiment.

The hinge 38 is located near the bottom of the base 26. A clasp 30 is interconnected to the hinge 38, such that the clasp 30 rotates relative to the base 26.

The platforms 24 and rods 28 are sized such that they can be affixed to the back 45 of the floral element 40. This provides that when the earring 12 is affixed to an ear lobe for example (not shown), the portion of the floral element 40 that is attached to the platforms 24 on the rods 28 does not flop down and cover the beads 15 detracting from the look of these floral earrings 12. The platforms 24 and rods 28 can be affixed to the back 45 of the floral element 40 with an adhesive or the platforms 24 and rods 28 could be affixed to the back 45 of the floral element 40 by any number of treatments such as heat, stitching and others.

The clasp 30 houses a post holder 32. The post holder 32 is made from a soft pliable material. The clasp 30 has a post hole 36 there through and the post holder 32 has a retaining hole 34 which when the post holder 32 is affixed to the clasp 30, both of these holes are collinear. Likewise, the post hole 36, retaining hole 34, floral center 41 are collinear. When the clasp 30 is affixed to a users earlobe for example, the post 22, floral center 41, post hole 36, and retaining hole 34 are collinear. This allows post 22 to pass through the ear lobe into and through the base 26, through the clasp 30 and be retained in the post holder 32. This thereby affixes the earring 12 to the user's ear lobe.

This embodiment of the earring 12 shows two rods 28. Other embodiments could have more or fewer rods 28 and any size or shape of the platform 24 and rods 28 dependent upon the size and design of the floral element 40 that needs to be supported.

Figure 5:
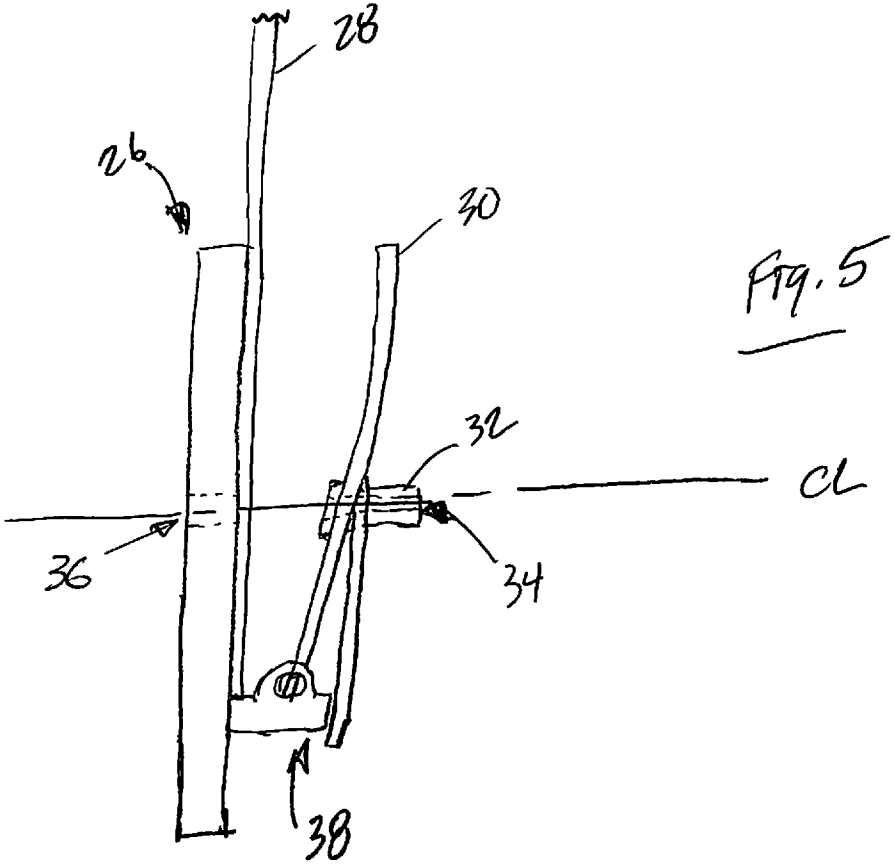
FIG. 5 shows a side detailed view of another embodiment of the base and related elements that are attached to the back of the floral element with an alternative hinge.

FIG. 5 shows a side detailed view of another embodiment of the base 26 and related elements that are attached to the back 45 of the floral element 40 with a different type of hinge 38 mechanism. The hinge 38 would not have to be located at the bottom of the base 26.

Figure 6:
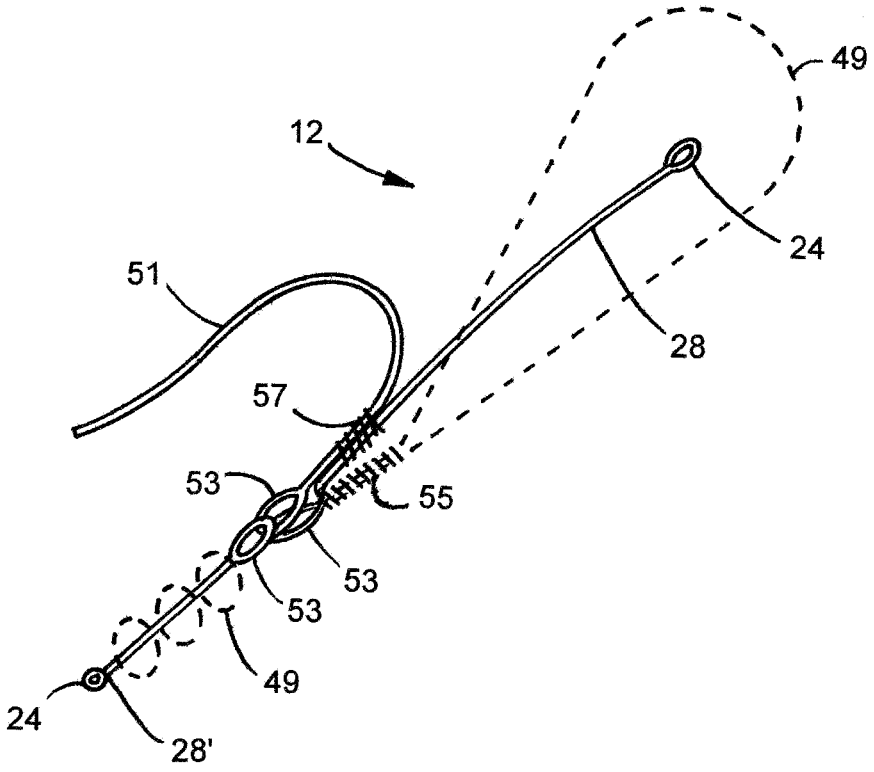
FIG. 6 shows another embodiment of the decorative earring.

FIG. 6 shows another embodiment of the earring 12. In this embodiment, the earring 12 has a hook 51 for insertion into the ears of those persons having pierced ears. A rod 28 provides support to the back of a decorative element 49, in this embodiment a feather. It should be understood that while this embodiment shows a feather as decorative element 49 many other similar types of elements could be affixed in this position, such as cloth, lace, stone and many other light weight materials that would enhance the earring 12.

The rod 28 is attached to the hook 51 with a clip 57 to insure that the decorative element 49 is and remains oriented correctly relative to the hook 51 and thereby the piercing in the ear, not shown. One end of the hook 51 has a loop 53 where the opposite end of the hook 51 gets inserted into the ear piercing. The hook 51 loop 53 is connected to a loop 53 of the rod 28. The opposite of end of the rod 28 can have a platform 24, this embodiment shows a loop by way of example and not by limitation.

The decorative element 49 connects to a retention device 55 which holds the decorative element in a fixed position relative to the retention device 55 and thereby the hook 51 and piercing in the ear. The retention device 55 has a loop 53 on one end.

The decorative element 49 can be attached to rod 28 and platform 24 by any suitable adhesive for the stability of decorative element 49.

The loops 53 of the hook 51, rod 28 and retention device 55 are interconnected. As an alternative, a second rod 28' with loop 53 could also be connected at this junction. Rod 28' could likewise hold decorative elements 49, in this embodiment are shown beads—by way of example and not a limitation, to further enhance the decorative appeal of the earrings 12.

It will now be apparent to those skilled in the art that other embodiments, improvements, details and uses can be made consistent with the letter and spirit of the foregoing disclosure and within the scope of this application, which is limited only by the following claims, construed in accordance with the patent law, including the doctrine of equivalents.

What is claimed is:

1. A device for retaining a floral jewelry element to a user, the device comprising:

a center with a face on one side and a back on the other;

the face having at least one ring attached, the at least one ring for interchangeably attaching decorative elements;

the back having located there upon a post, the post approximately centrally located in the center;

a floral element with a floral center; a hole located approximately at the floral center;

a base, the base having a front and a back;

a post hole located approximately in the center of the base extending from the front to the back, at least one rod affixed to the back, the at least one rod having at least one platform attached there to, the platform for attachment to the floral element, a hinge attached to the back, the hinge having a clasp, the clasp having a post holder, the post holder having a retaining hole there through such that when the clasp is in the closed position, the post is inserted into the floral center post hole and removably secured in the retaining hole of the post holder.

2. A device for securing a decorative element, the device comprising:

a center, the center having a face and a back surface, a post attached near the center of the back surface, at least one ring attached to the face;

a floral element having a front and a back and a floral center, the floral center having a hole there through;

a base having a front and a back, at least one rod affixed to the back, the at least one rod having a platform on one end and terminating at a hinge at the other end, the hinge attached to a clasp, the clasp housing a post holder, the post holder having a retaining hole there through, the clasp rotatable around the hinge such that the clasp contacts the back of the base in a first position and rotates away from the back in a second position; and whereby the post is inserted through the hole of the floral element into a post hole of the base and into the retaining hole of the post holder thereby retaining these elements together.

* * * * *